US009624624B2

(12) United States Patent
Filion et al.

(10) Patent No.: US 9,624,624 B2
(45) Date of Patent: Apr. 18, 2017

(54) INFRARED ASPHALT HEATING APPARATUS AND METHOD

(71) Applicant: R. Filion Manufacturing Inc., Newport, NH (US)

(72) Inventors: Roger G Filion, Charlestown, NH (US); Randall L Tewksbury, Newport, NH (US)

(73) Assignee: R. FILION MANUFACTURING INC., Newport, NH (US)

( * ) Notice: Subject to any disclaimer, the term of this patent is extended or adjusted under 35 U.S.C. 154(b) by 0 days.

(21) Appl. No.: 14/549,051

(22) Filed: Nov. 20, 2014

(65) Prior Publication Data

US 2015/0139727 A1 May 21, 2015

Related U.S. Application Data

(60) Provisional application No. 61/906,552, filed on Nov. 20, 2013.

(51) Int. Cl.

| | |
|---|---|
| ***E01C 7/06*** | (2006.01) |
| ***E01C 7/18*** | (2006.01) |
| ***E01C 23/06*** | (2006.01) |
| ***E01C 23/14*** | (2006.01) |

(52) U.S. Cl.
CPC ..... *E01C 7/187* (2013.01); *E01C 23/065* (2013.01); *E01C 23/14* (2013.01)

(58) Field of Classification Search
CPC ..... E01C 23/14
See application file for complete search history.

(56) References Cited

U.S. PATENT DOCUMENTS 3,067,811 A * 12/1962 Webster ..... A47J 37/06 126/39 J
3,129,749 A * 4/1964 Honger ..... F23C 99/00 431/329
3,199,572 A * 8/1965 Boulet ..... F23D 14/14 431/329
3,221,617 A * 12/1965 Quigg ..... E01C 23/082 126/271.2 A
3,311,104 A * 3/1967 Wollner ..... E01C 23/14 126/271.2 A (Continued)

OTHER PUBLICATIONS

Ray-Tech Infrared Corporation Pavement Heaters website: http://www.raytechinfrared.com/pavement_heater.*

(Continued)

*Primary Examiner* — Thomas B Will
*Assistant Examiner* — Katherine Chu
(74) *Attorney, Agent, or Firm* — Maine Cernota & Rardin

(57) ABSTRACT

An infrared asphalt heating and repair apparatus includes a converter having downward facing slits cut therein to provide enhanced durability over prior art ceramic blanket or metal ribbon style heaters. In embodiments, the slits are cut by a milling machine, which may be an automatic milling machine, a band saw, or a laser. Embodiments also provide for more uniform heating over prior art solutions, while largely preventing damaging and costly flame-through events. Because the heat is more uniform than that of the prior art, lower temperatures can be used to achieve similar results, thereby extending equipment life, lowering fuel costs, and reducing warm-up times.

18 Claims, 11 Drawing Sheets

(56) References Cited

U.S. PATENT DOCUMENTS 3,852,025 A * 12/1974 Placek ..... F23D 14/145 126/92 B
3,941,116 A * 3/1976 Placek ..... F24C 3/14 126/92 B
3,975,140 A * 8/1976 Placek ..... B60H 1/0025 126/92 B
4,052,593 A * 10/1977 Ebert ..... B29B 13/023 219/405
4,601,605 A * 7/1986 Damp ..... E01C 23/065 126/271.2 A
4,711,600 A * 12/1987 Yates ..... E01C 23/14 126/271.2 A
5,645,043 A * 7/1997 Long ..... F24C 1/10 126/91 R
7,611,351 B2 * 11/2009 Krauklis ..... F23D 14/145 431/170
8,562,247 B2 * 10/2013 Giles ..... E01C 23/14 404/118
9,182,119 B2 * 11/2015 Mach ..... F23D 14/145
9,453,642 B2 * 9/2016 Arnold, III ..... F23D 14/56
2007/0071552 A1 * 3/2007 Velsor ..... E01C 23/14 404/77
2008/0292401 A1 * 11/2008 Potts ..... E01C 19/238 404/95
2010/0021233 A1 * 1/2010 Chandler ..... E01C 23/14 404/77
2012/0000457 A1 * 1/2012 Paysant ..... A47J 37/0713 126/25 R
2014/0242529 A1 * 8/2014 Arnold, III ..... F23D 14/56 431/157
2014/0248570 A1 * 9/2014 Zhang ..... F24C 3/04 431/263

OTHER PUBLICATIONS

Kasi Infrared Asphalt Equipment website: http://www.kasiinfrared.com/Infrared-Asphalt-Equipment.php.*

* cited by examiner

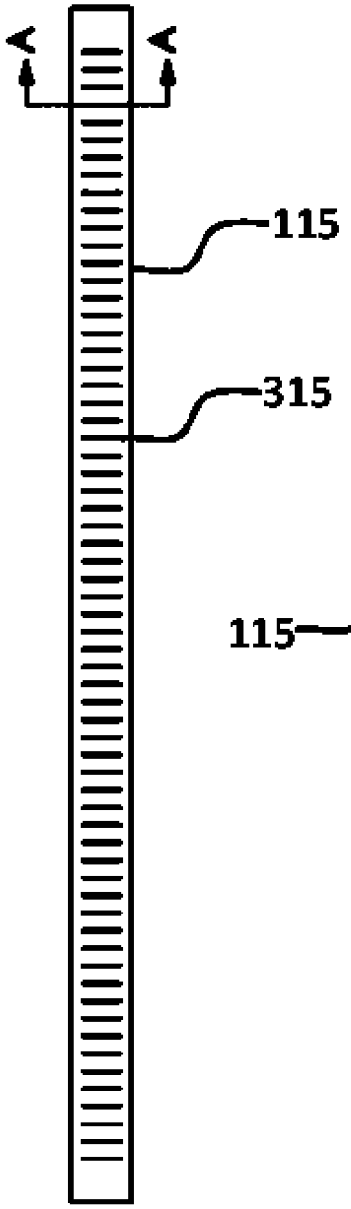
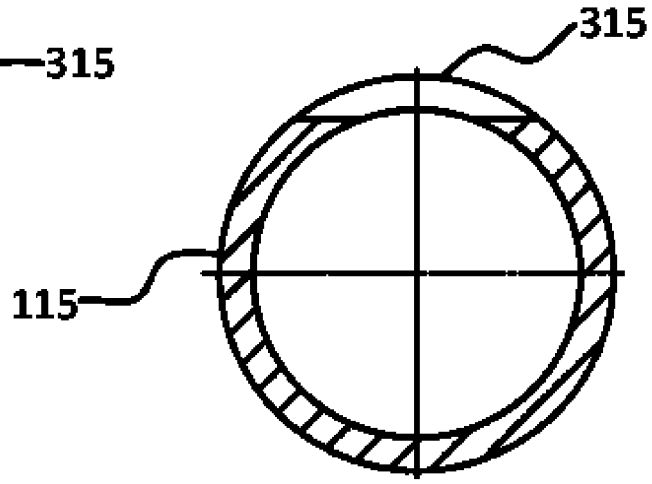
Fig. 6A
Fig. 6B

INFRARED ASPHALT HEATING APPARATUS AND METHOD

RELATED APPLICATIONS

This application claims priority to U.S. Provisional Application No. 61/906,552, filed on Nov. 20, 2013. This application is herein incorporated by reference in its entirety for all purposes.

FIELD OF THE INVENTION

The invention relates to asphalt repair, and more particularly, to infrared heating and repair of asphalt.

BACKGROUND OF THE INVENTION

Asphalt is in use in most places that vehicles are. Asphalt is durable, economical, and should last for many years. Asphalt will not last forever though, and some sections of asphalt may well deteriorate prematurely, leading to failure of surrounding portions if not addressed promptly. Common causes of premature failure in asphalt sections are excessive water flow, poor drainage, sinking of underlying ground, and oil, grease, gasoline, or chemical oxidation.

The United States alone spends roughly $16 billion USD annually on repair of existing roadways (calculated based on the Federal Highway Administration's Highway Statistical Series, for years 2004-2008). According to the American Association of State Highway and Transportation Officials, every $1 spent to keep a road in good condition avoids $6-14 needed later to rebuild the same road once it has deteriorated significantly (American Association of State Highway and Transportation Officials (AASHTO) and The Road Information Project. (2009). "Rough Roads Ahead: Fix Them Now or Pay for It Later." http://roughroads.transportation.org/.)

To this end, many repair techniques have been developed, such as "throw-and-go" (placing fresh asphalt into a pothole or crack, with no further steps), "throw-and-roll" (similar to throw-and-go, but also includes an attempt to compact the fresh asphalt by driving over it with a vehicle), spray injection (requires customized vehicles and materials, involves spraying of asphalt mix through a nozzle and onto the existing asphalt to be repaired), edge seal (cutting the deteriorated pavement out, adding fresh asphalt, and compacting with vibratory rollers or the like), and infrared heating and repair. Of these, infrared heating and repair of damaged asphalt has many benefits, including seamless bonding of the patch to the surrounding asphalt, requiring only one trip to the site of the repair, less new asphalt being necessary to make a similar repair, fewer freeze/thaw issues occurring, and less potential for injury of workers, because there is no need for saw cutting, jack hammering, spraying of solvents, or the like.

Existing infrared asphalt repair apparatus are either of the ceramic blanket or metal ribbon variety. Ceramic blanket heaters typical of the prior art use LPG (Liquefied Petroleum Gas) to heat a ceramic blanket, which in turn radiates infrared energy. Metal ribbon heaters generally use a plurality of thin strips (ribbons) of metal that are placed in a channel, bent in a wave-like pattern, and welded every 6-12". LPG is channeled through the orifices formed between the metal ribbons, and lit. This LPG then heats grids, typically made of nickel chromium, which radiate infrared energy into the pavement. Infrared heating is used instead of purely convective heating due to superior efficiency. By using infrared radiation, less heat is wasted heating up the surrounding air, because the infrared radiation travels through the air, losing little energy, before being absorbed by the asphalt. Infrared heating also provides quicker heating of sub-surface asphalt than purely convective heating. Because the actual heating is done through infrared radiation, rather than convective heating, the asphalt is evenly heated and softened throughout its depth. However, the current state of the art in infrared heating and repair of asphalt is not without its problems.

Ceramic blanket heaters will eventually need to have the ceramic blanket replaced at substantial cost, either due to normal use or because it has developed tears in the material. The efficiency of ceramic blanket heaters will also deteriorate because of a buildup of carbon and other combustion byproducts on the ceramic blanket over time.

Metal ribbon infrared asphalt heating and repair devices also suffer issues that prevent their widespread adoption, typically suffering from uneven and inconsistent heating, unreliable operation, high temperature operation (reduced durability), and high fuel usage. In particular, the sizes of the orifices created by bending and periodically welding metal ribbon material in a channel are inconsistent, in turn affecting the uniformity of heat given off by the device. This variation in orifice size and heat requires additional expenditure of fuel to achieve at least a minimum usage temperature throughout the heated region, and also allows for occasional large bursts of flame through these ribbons, referred to as flame-throughs, which can cause failure of the nickel chromium grids, as well as scorching of the asphalt. The higher than necessary operating temperature required because of the non-uniform output of these devices also considerably shortens the life of the nickel chromium material.

What is needed, therefore, are apparatus for infrared heating and repair of pavement that use less fuel, eliminate flame-through events, provide more uniform output, and are more robust than those of the prior art.

SUMMARY OF THE INVENTION

One general aspect of the present invention is an infrared asphalt heating and softening system for infrared repair of asphalt, comprising at least one blower operatively connected to a fuel supplying conduit, at least one manifold, fixed to a frame, in communication with the fuel supplying conduit, at least one converter, which may, in embodiments, be of a cylindrical shape and made of stainless steel, in fuel communication with said manifold and having a plurality of downward facing slits through which fuel can emerge and combust, the converter being positioned within the frame, at least one reflector configured to reflect infrared radiation produced by the converter downwardly, and at least one grid, made of infrared emitting material, configured such that a combustion chamber is formed between the converter and the grid, the grid further configured to absorb heat produced in the combustion chamber and re-emit the heat downwardly in the form of infrared radiation.

Another embodiment of the present disclosure provides such an infrared asphalt heating and softening system wherein the downward facing slits of the converters, which may be made of stainless steel and cylindrical in shape, are approximately 0.4688"-0.5000" wide. These slits may also be between approximately 0.025"-0.035" thick.

Yet another embodiment of the present invention provides such an infrared asphalt heating and softening system for infrared asphalt repair wherein the downward facing slits of the at least one converter number 64 slits per 34" of converter length.

Still another embodiment of the present invention provides such an infrared asphalt heating and softening system wherein the aforementioned grid is made of nickel chromium.

A still further embodiment of the present invention provides such an infrared asphalt heating and softening system wherein said the at least one reflector is made using stainless steel.

Even another embodiment of the present invention provides such an infrared asphalt heating and softening system wherein a first slit and a last slit are positioned 1.250" from opposing ends of the converter.

An even further embodiment of the present invention provides such an infrared asphalt heating and softening system wherein the plurality of downward facing slits are produced using a milling machine.

A still even further embodiment of the present invention provides such an infrared asphalt heating and softening system wherein the plurality of downward facing slits are produced using a band saw.

A still yet even further embodiment of the present invention provides such an infrared asphalt heating and softening system wherein the plurality of downward facing slits are produced using a laser.

Another general aspect of the present invention is a method for infrared repair of asphalt, comprising providing an infrared asphalt heating and softening system including at least one blower operatively connected to a fuel supplying conduit, a manifold, fixed to a frame, in communication with the fuel supplying conduit, at least one converter in fuel communication with the manifold and having a plurality of downward facing slits through which the fuel can emerge and combust, the converter being positioned within the frame, at least one reflector configured to reflect infrared radiation produced by the converter downwardly, toward asphalt to be repaired, and at least one grid, made of infrared emitting material, configured to absorb heat produced by the converter and re-emit the heat toward the asphalt as infrared radiation, heating an area of asphalt to be repaired using the infrared asphalt heating and softening system until it is soft enough to be scarified using hand tools; scarifying and repositioning the softened asphalt, smoothing the softened asphalt, and adding fresh asphalt over the smoothed asphalt.

Another embodiment of the present invention provides such a method, further comprising compacting the fresh asphalt.

Yet another embodiment of the present invention provides such a method, wherein compacting of the fresh asphalt is accomplished using a vibratory compactor.

A yet further embodiment of the present invention provides such a method, wherein compacting of the fresh asphalt is accomplished using compaction equipment selected from the group consisting of paver screeds, steel wheel rollers, and pneumatic tire rollers.

A still further embodiment of the present invention provides such a method, further comprising adding maltenes to the heated and scarified asphalt prior to smoothing. Additional embodiments also add asphaltenes with the maltenes.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 6A is a bottom elevation view of a converter, in accordance with one embodiment of the present disclosure;

FIG. 6B is a section view showing the slit shape used in a converter, in accordance with one embodiment of the present disclosure;

DETAILED DESCRIPTION

Embodiments of the present invention provide precisely slotted tube-style converter assemblies, which can be manufactured to tighter tolerances, in lieu of prior art ribbon or ceramic blanket assemblies, producing a more consistent converter orifice size and a more robust apparatus.

Due to the more consistent sizes of the converter orifices, flame heating is produced more uniformly over the entire heated area as compared to the prior art ribbon converters, so that lower average operating temperatures are required. This leads to reduced fuel consumption and enhanced durability of the asphalt repair equipment.

Figure 1:
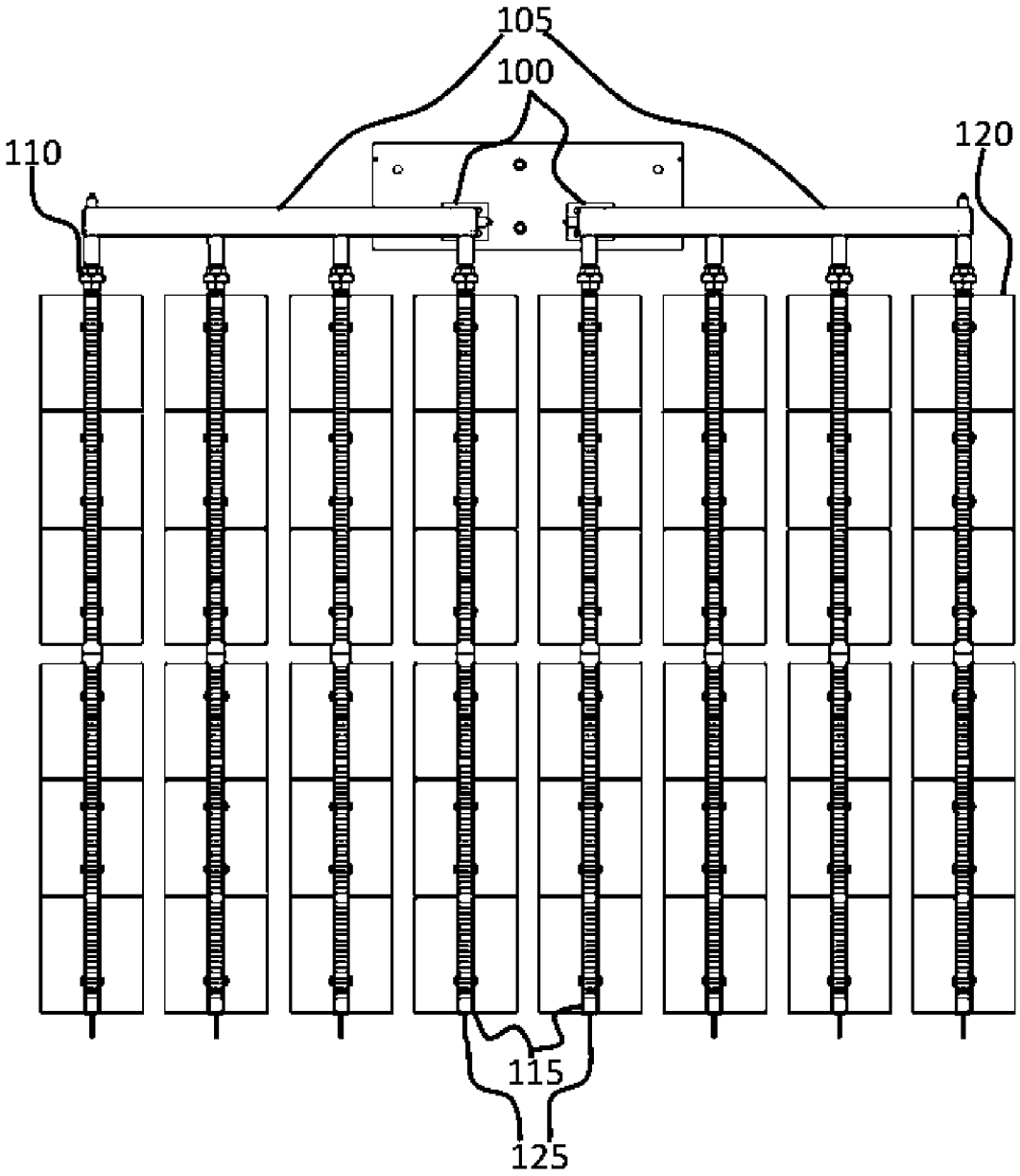
FIG. 1 is a bottom elevation view of one embodiment of the infrared pavement repair apparatus of the present disclosure.
Figure 2:
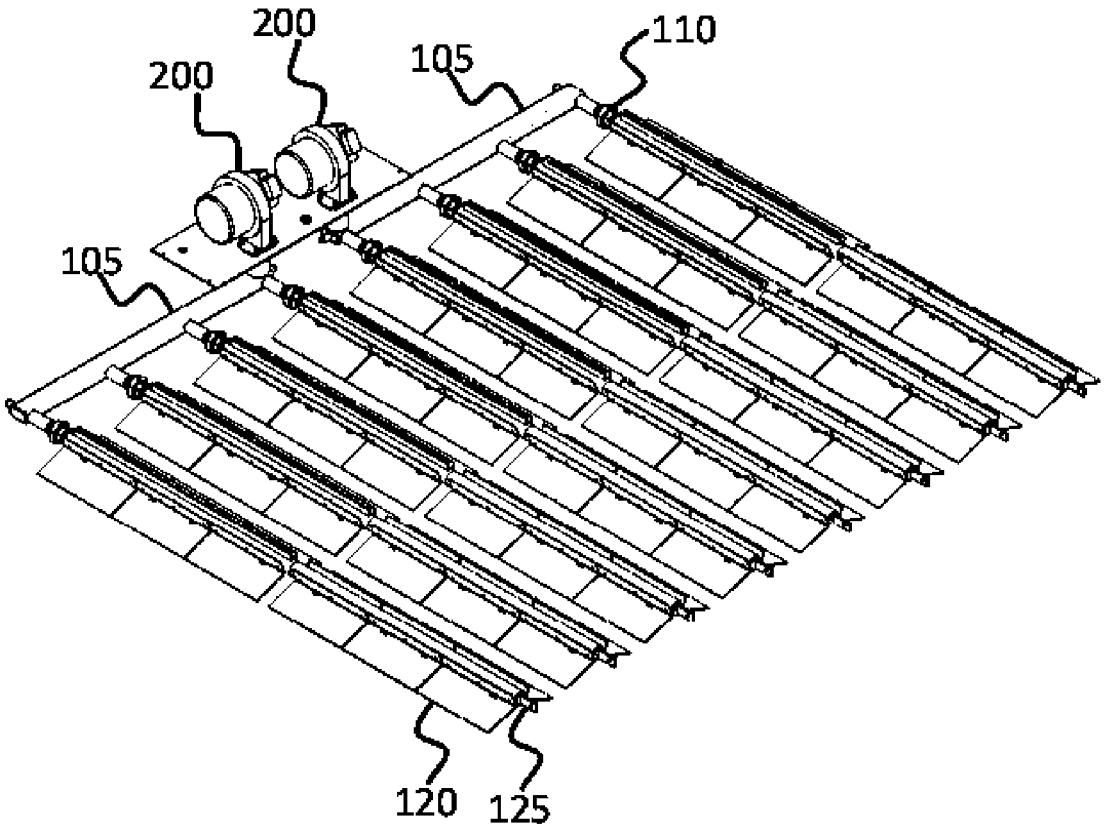
FIG. 2 is a front, top, right-side perspective view of an infrared pavement repair apparatus in accordance with one embodiment of the present disclosure.

One embodiment of an infrared asphalt heating apparatus in accordance with the present disclosure is illustrated in FIGS. 1 and 2. This embodiment may use multiple fuel connections 100, each in communication with fuel supply manifolds 105, which are in further communication with converters 115, which may be beneficially attached through the use of pipe fittings 110, although many other types of fittings may also be used. The number of converters 115, fuel connections 100 and fuel supply manifolds 105 is scalable, in embodiments, and may be as few or as many as is necessary to expeditiously complete the repair task at hand. Reflectors 120 are also shown, which act to focus infrared radiation, produced by combustion of fuel in the converters 115 and subsequent heating of a specially designed grid 800 (not shown in FIG. 1 or 2), into asphalt to be repaired when the apparatus is in operation.

Figure 10:
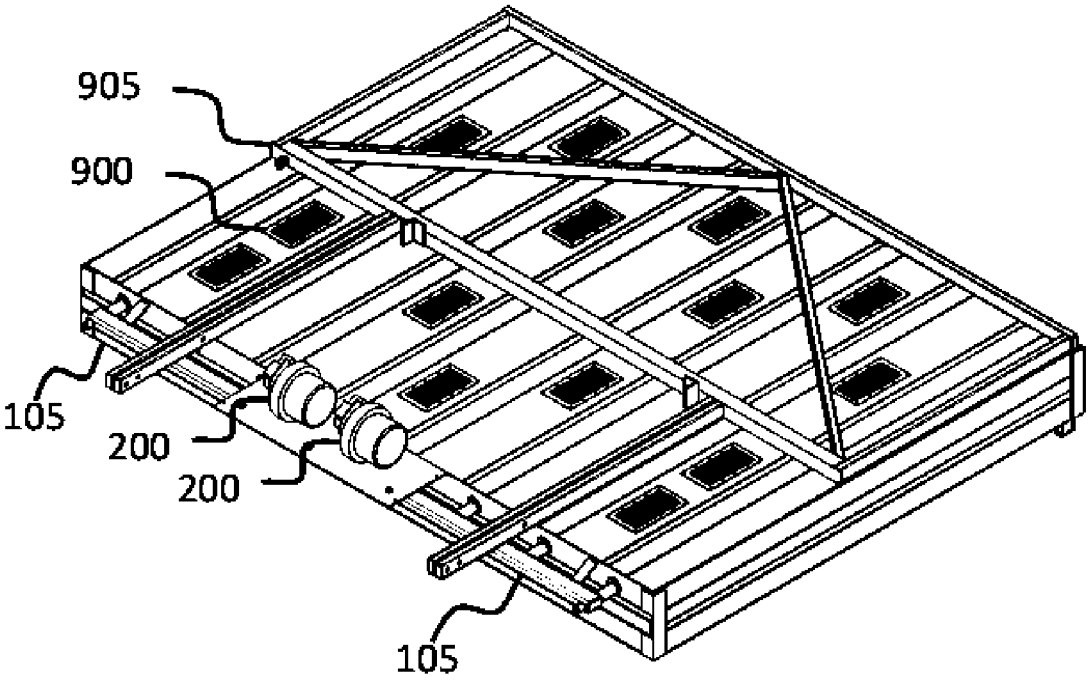
FIG. 10 is a top, rear, right-side perspective view of a frame and subassemblies which comprise an infrared asphalt repair apparatus, in accordance with one embodiment of the present disclosure.
Figure 11:
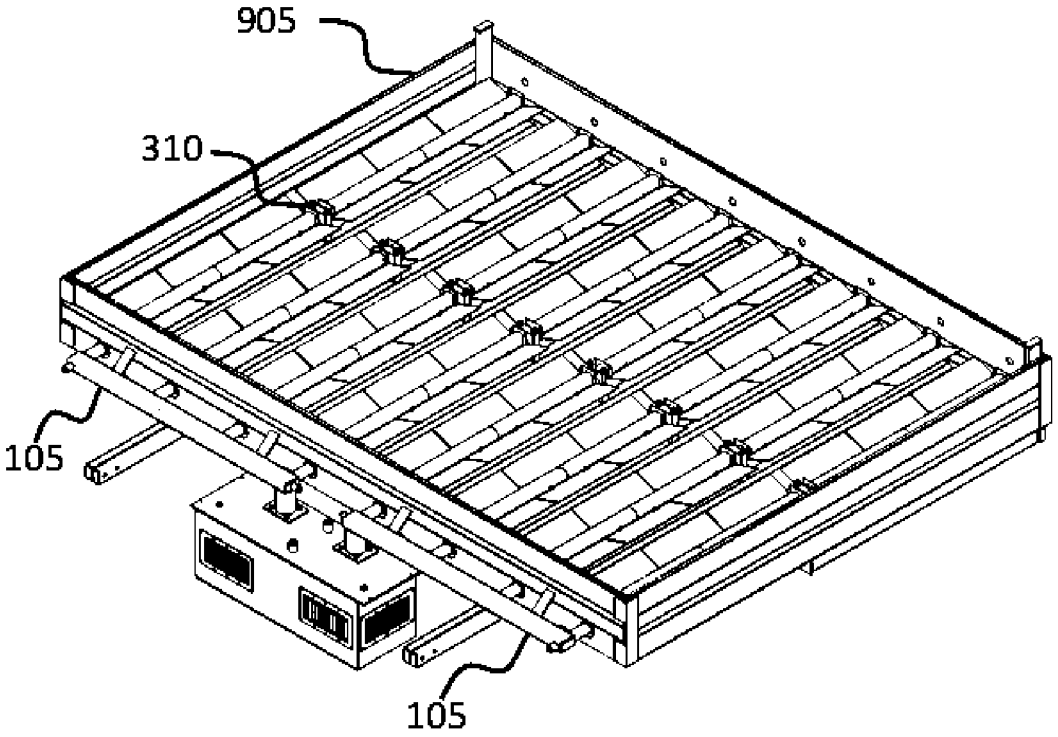
FIG. 11 is a bottom, rear, left-side perspective view of a frame and subassemblies which comprise an infrared asphalt repair apparatus, in accordance with one embodiment of the present disclosure.

The converters 115 may be secured to a frame 905 (shown in FIG. 10), as is described in more detail below with reference to FIGS. 10 and 11, using provided tabs 125, which include connection points 405, as discussed in more detail below with reference to FIG. 4. The frame 905 may further comprise grates 900, thereby allowing airflow between a bottom portion of the frame 905 and a top portion of the frame 905 Rivets, bolts, welding and other methods of fastening the converters to frame 905, which are of a suitable size, given the intended repair task, may also be utilized.

Figure 4:
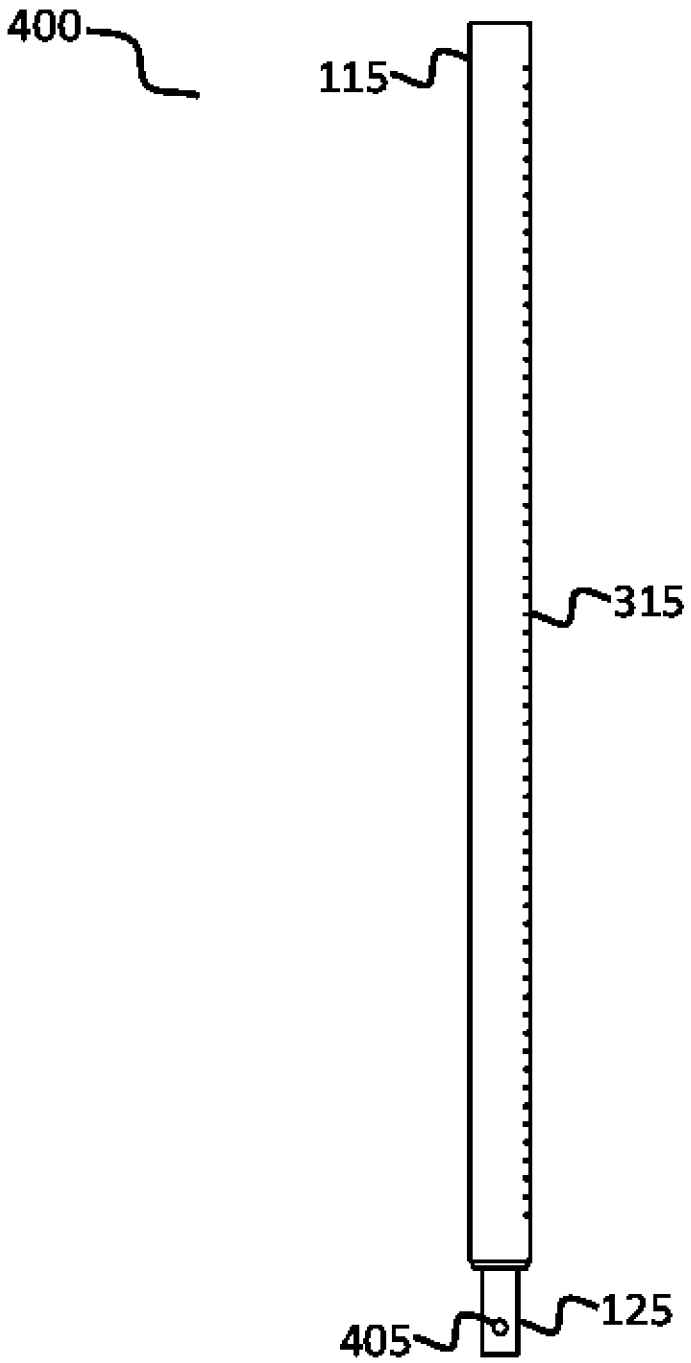
FIG. 4 is a left-side elevation view of a converter, specifically a top converter, in accordance with one embodiment of the present disclosure.
Figure 5:
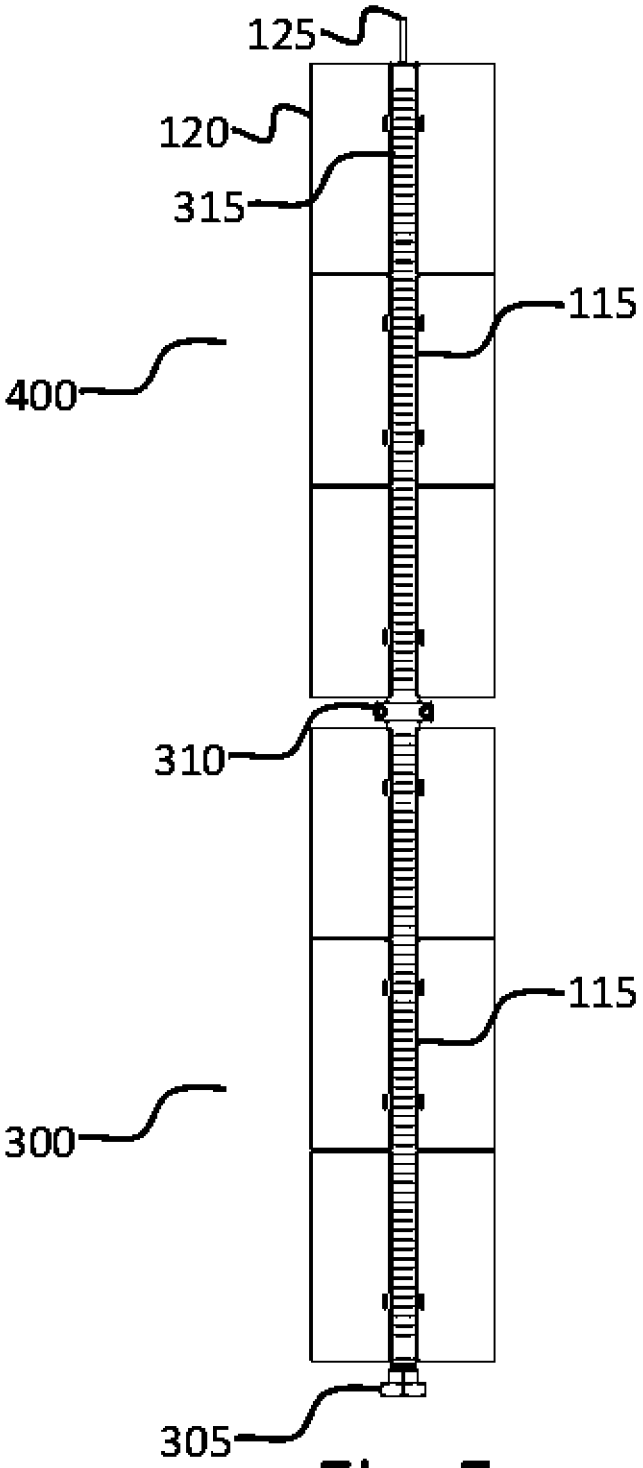
FIG. 5 is a bottom elevation view of assembled top and bottom converters with reflectors, in accordance with one embodiment of the present disclosure.
Figure 7:
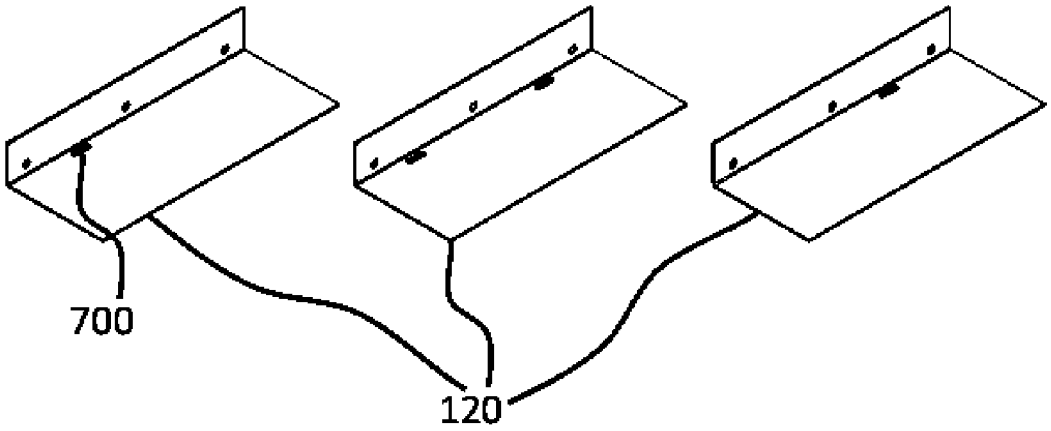
FIG. 7 is a top, front, right-side perspective view of, from left to right, respectively, a left-reflector, center reflector and right reflector, in accordance with one embodiment of the present disclosure.

As best illustrated in FIG. 5, some embodiments of the present invention utilize interconnect-able converters 115, allowing for the apparatus to be scaled to the project at hand while minimizing the size of shipped components and the need to manufacture differently sized components. While embodiments of the distinct converters 115 utilize similar slit 315 patterns and designs, hardware for the interconnection of converters differs, dependent on the desired position of the converter in its frame 905, as is described in more detail below with reference to FIGS. 3, 4 and 5.

Figure 3:
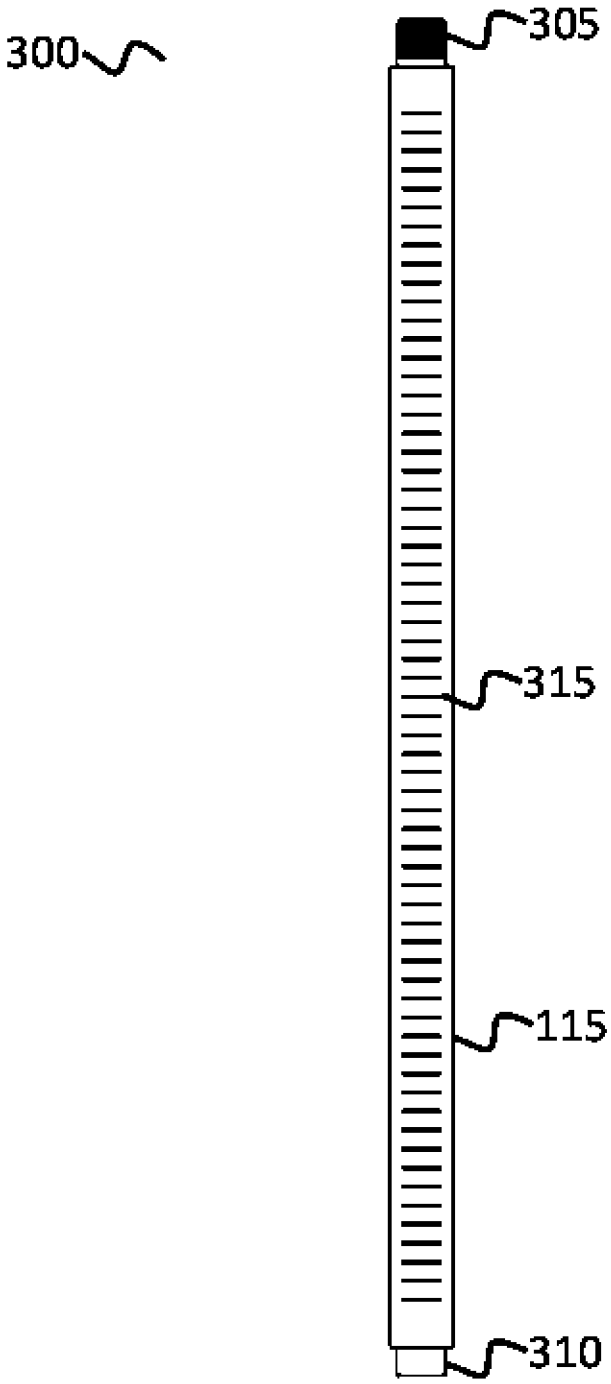
FIG. 3 is a bottom elevation view of a converter, specifically a bottom converter, in accordance with one embodiment of the present disclosure.

Now referring to FIG. 3, bottom converter assemblies 300, according to the embodiment depicted may utilize pipe nipples 305 for connection to a pipe fitting 110, in operative communication with a fuel supply manifold 105, in addition to providing a plain pipe nipple 310 on an opposite end, which may be used for interconnection with a top converter assembly 400, as shown in FIG. 4.

The top converter 400 of FIG. 4, in embodiments, includes a tab 125 for securing the top converter assembly 400 to the apparatus frame 905. The tab may be secured by welding in some embodiments to a converter 115 including slits 315 to provide a top converter 400. Reflectors 120, including slots 700 for holding infrared emitting grids 800, may also be attached.

FIG. 5 illustrates one embodiment of the present invention, wherein a bottom converter assembly 300 is operatively connected to a top converter assembly 400 through use of a plain pipe nipple connection 310.

FIGS. 6A and 6B illustrate a converter 115 with slits 315 configured in accordance with one embodiment of the present invention. These slits may be cut into the material using a variety of techniques and at a variety of different sizes, however, use of a band-saw or other tool providing a similar profile cut, with the cut itself having measuring between 0.4688"-0.5000" in width, has been shown to produce a desirable flame spread suitable for asphalt repair. In embodiments, slits 315 may be produced in a converter 115 through use of a milling machine and a fixture. These slots may desirably be 0.025" thick to achieve optimal flame spread and energy transfer to the infrared emitting grid 800.

Other embodiments of the present invention may have slits 315 cut with a laser, a band saw, a milling machine, or a variety of other means, to achieve alternative flame spread patterns, which may be beneficial for specific uses.

Figure 8:
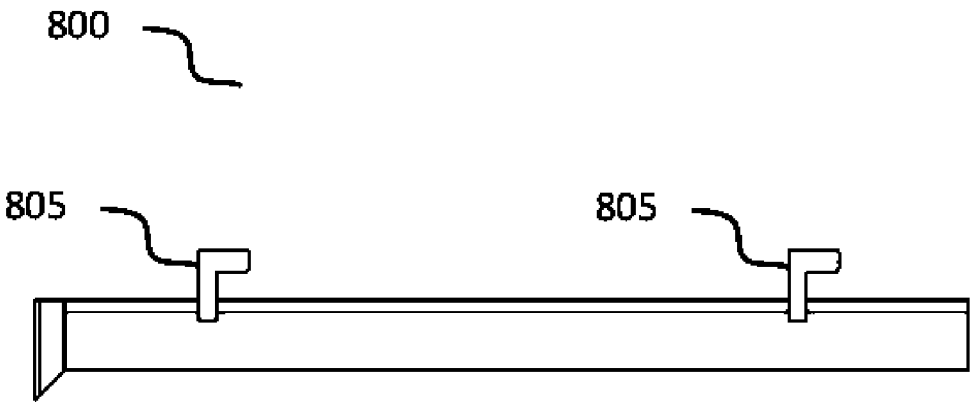
FIG. 8 is a right-side elevation view of a grid used for generation of infrared energy, in accordance with one embodiment of the present disclosure.
Figure 9:
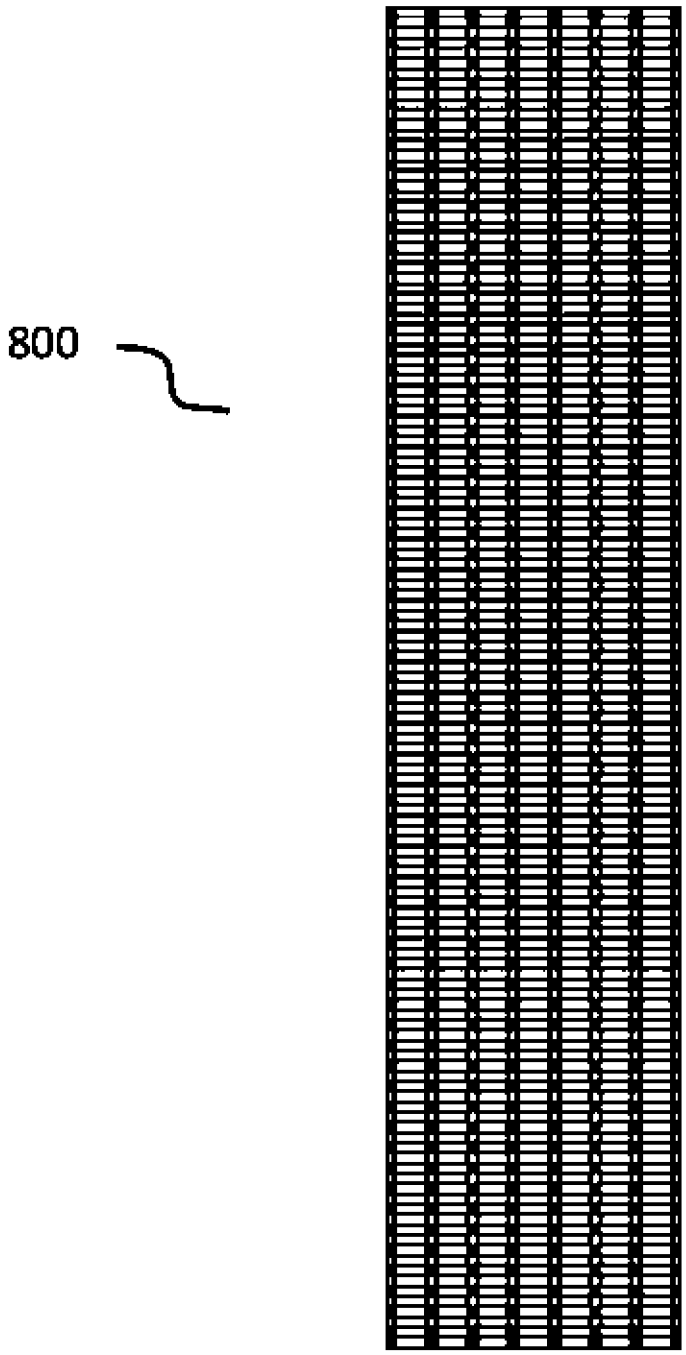
FIG. 9 is a detail view of the grid of FIG. 8, in accordance with one embodiment of the present disclosure.

Reflectors 120 used in embodiments of the present invention can be made from sheet metal or similar material. Construction of embodiments of the present invention includes producing slots 700 in the reflector material suitable for holding infrared emitting grids 800 in place. Embodiments of such grids 800 are fastened to the reflectors via grid legs 805 as shown in FIG. 8.

In embodiments, a dual 12 volt blower system 200 may be used to provide an optimal air/fuel mix to the converters 115. The fuel may be liquid petroleum gas (LPG), propane, or any of a number of liquid or gaseous fuels.

Various embodiments of the present invention use nickel chromium as the infrared radiation emitting grid 700 material, as well as for the converters 115 themselves.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed.

Among that which is claimed is:

1. An infrared asphalt heating and softening system for infrared repair of asphalt, comprising:

at least one blower operatively connected to a fuel supplying conduit;

at least one manifold, fixed to a frame, in communication with said fuel supplying conduit;

at least one converter in fuel communication with said manifold and having a plurality of downward facing slits through which fuel can emerge and combust, the converter being positioned within said frame;

at least one reflector configured to reflect infrared radiation produced by the converter during combustion of said fuel downwardly; and at least one grid, made of infrared emitting material, configured such that a combustion chamber is formed between said converter and said grid, said grid further configured to absorb heat produced in said combustion chamber and re-emit said heat downwardly in the form of infrared radiation.

2. The infrared asphalt heating and softening system of claim 1 wherein said downward facing slits of said at least one converter are between approximately 0.4688" and 0.5000" in width.

3. The infrared asphalt heating and softening system of claim 1 wherein said downward facing slits of said at least one converter are between approximately 0.025" and 0.035" in thickness.

4. The infrared asphalt heating and softening system of claim 1 wherein said downward facing slits of said at least one converter number 64 slits per 34" of converter length.

5. The infrared asphalt heating and softening system of claim 1 wherein said converter is made of stainless steel.

6. The infrared asphalt heating and softening system of claim 1 wherein said converter is cylindrical in shape.

7. The infrared asphalt heating and softening system of claim 1 wherein said grid is made of nickel chromium.

8. The infrared asphalt heating and softening system of claim 1 wherein said at least one reflector is made of stainless steel.

9. The infrared asphalt heating and softening system of claim 1 wherein a first slit and a last slit are positioned approximately 1.250" from opposing ends of the converter.

10. The infrared asphalt heating and softening system of claim 1 wherein the plurality of downward facing slits are produced using a milling machine.

11. The infrared asphalt heating and softening system of claim 1 wherein the plurality of downward facing slits are produced using a band saw.

12. The infrared asphalt heating and softening system of claim 1 wherein the plurality of downward facing slits are produced using a laser.

13. A method for infrared repair of asphalt, comprising:

providing an infrared asphalt heating and softening system including at least one blower operatively connected to a fuel supplying conduit, a manifold, fixed to a frame, in communication with said fuel supplying conduit, at least one converter in fuel communication with said manifold and having a plurality of downward facing slits through which the fuel can emerge and combust, the converter being positioned within said frame, at least one reflector configured to reflect infrared radiation produced by the converter downwardly, toward asphalt to be repaired, and at least one grid, made of infrared emitting material, configured to absorb heat produced by said converter and re-emit the heat toward said asphalt as infrared radiation;

heating an area of said asphalt to be repaired using said infrared asphalt heating and softening system until said asphalt is soft enough to be scarified using hand tools;

scarifying and repositioning said asphalt;

smoothing said asphalt; and adding fresh asphalt over said smoothed asphalt.

14. The method of claim 13, further comprising compacting said fresh asphalt.

15. The method of claim 14, wherein said compacting of said fresh asphalt is accomplished using a vibratory compactor.

16. The method of claim 14, wherein said compacting of said fresh asphalt is accomplished using compaction equipment selected from the group consisting of paver screeds, steel wheel rollers, and pneumatic tire rollers.

17. The method of claim 13, further comprising adding maltenes to said heated and scarified asphalt prior to smoothing said asphalt.

18. The method of claim 16, further comprising adding asphaltenes to said heated and scarified asphalt prior to smoothing said asphalt.

* * * * *